US012654889B2

(12) United States Patent
Galante et al.

(10) Patent No.: US 12,654,889 B2
(45) Date of Patent: Jun. 16, 2026

(54) SYSTEM AND METHOD FOR BOXING PRODUCTS

(71) Applicant: Fameccanica.Data S.p.A., San Giovanni Teatino Chieti (IT)

(72) Inventors: Dario Galante, San Giovanni Teatino Chieti (IT); Fabrizio Faieta, San Giovanni Teatino Chieti (IT)

(73) Assignee: Fameccanica.Data S.p.A., San Giovanni Teatino Chieti (IT)

( * ) Notice: Subject to any disclaimer, the term of this patent is extended or adjusted under 35 U.S.C. 154(b) by 0 days.

(21) Appl. No.: 19/214,634

(22) Filed: May 21, 2025

(65) Prior Publication Data

US 2025/0361042 A1 Nov. 27, 2025

(30) Foreign Application Priority Data

May 22, 2024 (IT) ..... 102024000011542

(51) Int. Cl.

| | |
|---|---|
| ***B65B 5/06*** | (2006.01) |
| ***B65B 35/36*** | (2006.01) |
| ***B65B 35/44*** | (2006.01) |
| ***B65B 35/56*** | (2006.01) |
| ***B65B 57/14*** | (2006.01) |

(52) U.S. Cl.
CPC ..... *B65B 5/06* (2013.01); *B65B 35/36* (2013.01); *B65B 35/44* (2013.01); *B65B 35/56* (2013.01); *B65B 57/14* (2013.01)

(58) Field of Classification Search
CPC ..... B65B 5/06; B65B 35/36; B65B 35/44; B65B 35/56; B65B 57/14; B65B 35/58; B65B 5/068; B65B 35/04; B65B 35/16
See application file for complete search history.

(56) References Cited

U.S. PATENT DOCUMENTS

2025/0250037 A1* 8/2025 Nannetti ..... B65B 35/24

FOREIGN PATENT DOCUMENTS

| | | | |
|---|---|---|---|
| EP | 2657138 | B1 | 12/2016 |
| WO | 2023038024 | A1 | 3/2023 |
| WO | 2023199253 | A1 | 10/2023 |

OTHER PUBLICATIONS

Search Report dated Jan. 17, 2025. 7 pages.

* cited by examiner

*Primary Examiner* — Veronica Martin
(74) *Attorney, Agent, or Firm* — RMCK Law Group PLC

(57) ABSTRACT

A system for boxing products and method.

10 Claims, 4 Drawing Sheets

SYSTEM AND METHOD FOR BOXING PRODUCTS

CROSS-REFERENCE TO RELATED APPLICATION

This application claims priority to Italian Patent Application No. 102024000011542 filed on May 22, 2024. The disclosure of the above application is incorporated herein by reference in its entirety.

FIELD OF THE INVENTION

The present invention relates to a system and a method for boxing products.

The invention has been developed with a view to its application in the field of the production of absorbent sanitary articles, for boxing packages of absorbent sanitary articles enclosed in bags coming from a production line.

However, the invention is not limited to this specific field and can be used in all cases where products need to be boxed at the end of a production line.

PRIOR ART

Systems for boxing products at the end of a production line represent a crucial element in industrial automation. These systems, often equipped with advanced robotic technology, are designed to ensure efficiency and precision in product packaging. Using automatic handling units equipped with anthropomorphic robots or similar, these systems can manage a wide range of product sizes and types, adapting to the specific needs of each customer. Customization is a key aspect, allowing systems to be configured to handle variable production volumes and respond optimally to market dynamics. The efficiency of these systems translates significant improvement in into a productivity and the ability to respond quickly to changes in production needs.

In these systems, robotic boxing machines are used, designed and built to allow the vertical filling of boxes with previously formed product groups, in which the products within the groups are arranged with a predetermined orientation designed to optimally exploit the volume of the boxes.

A boxing machine may include: a product group conveyor, a first robotic unit for forming product groups on the product group conveyor, and a second robotic unit for picking up product groups from the product group conveyor and inserting the product groups into respective boxes. An example of a robotic boxing machine is described in EP2096035A1.

Generally, a boxing machine is associated with a main feeding conveyor configured to feed to the boxing machine an array of products aligned with each other in the transport direction. In the array, the products are arranged with constant relative distances, so as to form a flow of products with a regular cadence at the entrance of the boxing machine.

In certain cases, systems for feeding boxing machines may include buffers for accumulating products. Buffers serve to accumulate products coming from the production line in the event of a temporary stop of the boxing machine. The products deposited in the buffer are transferred to the main feeding conveyor when the production line stops.

In some cases, empty spaces may be created in the array of products fed to the boxing machine, for example due to product drops during advancement on the feeding conveyor, ejection of products from the array following a failed quality control, or picking of products from the feeding conveyor for forwarding to a quality control.

When there are empty spaces in the array of products fed to the boxing machine, the robotic unit that forms the product groups within the boxing machine must wait for the arrival of a subsequent product. This reduces the efficiency of the boxing machine.

OBJECT AND SUMMARY OF THE INVENTION

The object of the present invention is to provide a system and a method for boxing products that overcome the drawbacks of the prior art.

In particular, the present invention aims to avoid efficiency losses in the boxing system caused by the presence of empty spaces in the array of products fed to the boxing machine.

According to the present invention, this object is achieved by a system for boxing products having the features forming the subject of claim 1.

According to another aspect, the invention relates to a method for boxing products having the features forming the subject of claim 8.

BRIEF DESCRIPTION OF THE DRAWINGS

The present invention will now be described in detail with reference to the accompanying drawings, provided by way of non-limiting example, in which.

DETAILED DESCRIPTION

Figure 1:
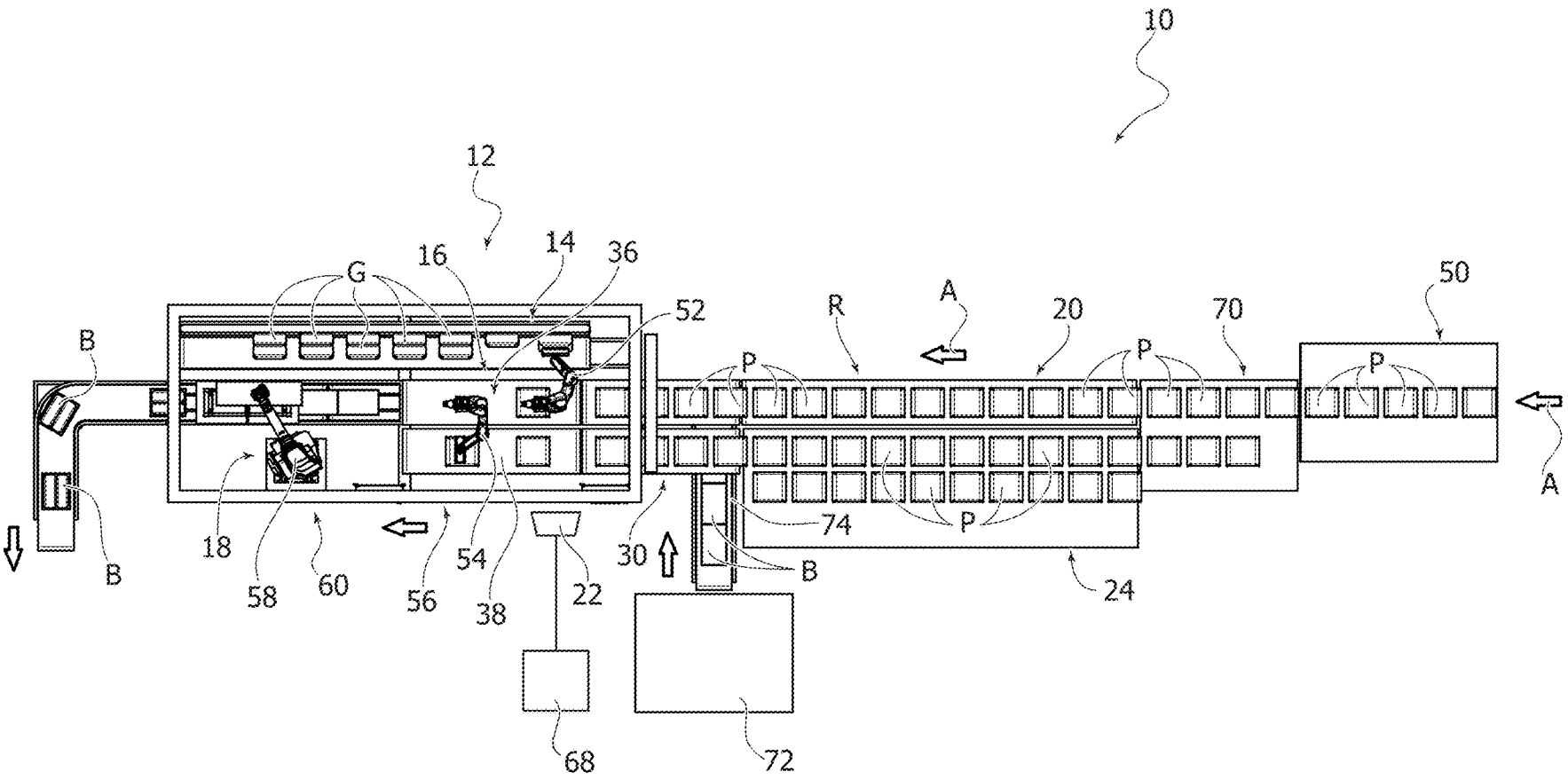
FIGS. 1-4 are schematic top views of various embodiments of a system for boxing products according to the present invention.

With reference to FIG. 1, numeral 10 indicates a system for boxing products P coming from the output of a production line 50. The products P may be, for example, packages of absorbent sanitary articles enclosed in flexible bags.

The system 10 comprises a boxing machine 12 configured to form product groups G and to insert such product groups G into respective boxes B. The boxing machine 12 includes a product group conveyor 14, a first robotic unit 16 configured to form product groups G on the product group conveyor 14, and a second robotic unit 18 configured to pick up product groups G from the product group conveyor 14 and to insert the product groups G into respective boxes B.

In possible non-illustrated embodiments, the first robotic unit 16 may comprise an anthropomorphic robot 52.

In the illustrated example, the first robotic unit 16 comprises two anthropomorphic robots 52, 54 located in a group-forming section 56 of the boxing machine 12, and the second robotic unit 18 comprises an anthropomorphic robot 58 located in a boxing section 60 of the boxing machine 12. The anthropomorphic robots 52, 54 are provided with respective product gripping heads. In the case of relatively light products P, such as packages of absorbent sanitary articles, the heads may be equipped with suction gripping elements.

The product group conveyor 14 may comprise a belt conveyor extending between the group-forming section 56 and the boxing section 60 of the boxing machine 12. The product group conveyor 14 may have a transport surface inclined with respect to both a vertical plane and a horizontal plane.

The system 10 comprises a main feeding conveyor 20 that transfers products P from the output of the production line 50 to the boxing machine 12. On the main feeding conveyor 20, the products P are aligned with each other in a transport direction A and form an array of products R in which the products P are spaced apart in the transport direction A by a constant distance.

The system 10 comprises a detection device 22 configured to detect the presence of empty spaces interrupting the continuity of the product array R. The empty spaces may be due to the absence of one or more products in positions of the product array R where products P should be present. The empty spaces in the product array R may be due to product P falling during transport, ejection of products P from the array R following a failed quality control, or the picking of products P from the array R for forwarding to a quality control.

The detection device 22 may be, for example, an optical detection device that visually inspects a portion of the product array R and detects the presence of empty spaces. The detection device may be placed in a stationary position in the group-forming section 56 of the boxing machine 12 or may be mounted on the head of one of the anthropomorphic robots 52, 54 located in the group-forming section 56 of the boxing machine 12. The detection device 22 sends information related to the presence of empty spaces in the product array R to an electronic control unit 68.

The system 10 comprises a buffer 24 for the accumulation of products P.

At the output of the production line 50, a diverter device 70 may be provided that selectively sends the products P to the main feeding conveyor 20 or to the buffer 24.

The system 10 comprises a replenishment conveyor 30 that feeds products P coming from the buffer 24 to the boxing machine 12.

In the embodiment of FIG. 1, the boxing machine 12 has a first entry station 36 that receives the product array R fed by the main feeding conveyor 20 and a second entry station 38 that receives products P fed by the replenishment conveyor 30. The first and second entry stations 36, 38 may include respective belt conveyors.

In operation, the first robotic unit 16 picks up successive products P located at the first entry station 36 and deposits them with a predetermined orientation G on the product group conveyor 14 so as to form successive product groups G.

The products P located at the second entry station 38 remain stationary and ready to be picked up when an empty space is detected at the first entry station 36.

When the detection device 22 detects the presence of one or more empty spaces in the product array R fed to the first entry station 36, the first robotic unit 16 picks up products P from the second entry station 38.

In this way, slowdowns in the production speed of the boxing machine 12 in case of empty spaces in the product array R are avoided.

The system 10 comprises a forming machine 72 that forms boxes B starting from cardboard blanks. The boxes B are transferred from the forming machine 72 to the boxing machine 12 via a box conveyor 74 that feeds the boxes B to the boxing section 60. In the boxing section 60, the second robotic unit 18 picks up the product groups G from the product group conveyor 14 and inserts the product groups G into the boxes B. When the boxes B are full, the box conveyor 74 carries the boxes B out of the boxing machine 12 and sends them to a closing machine. Advantageously, the box conveyor 74 extends below the belt conveyor located in the first entry station 36, so that the boxes B, during transfer to the boxing section 60, do not obstruct the working areas of the anthropomorphic robots 52, 54 located in the group-forming section 56.

Figure 2:
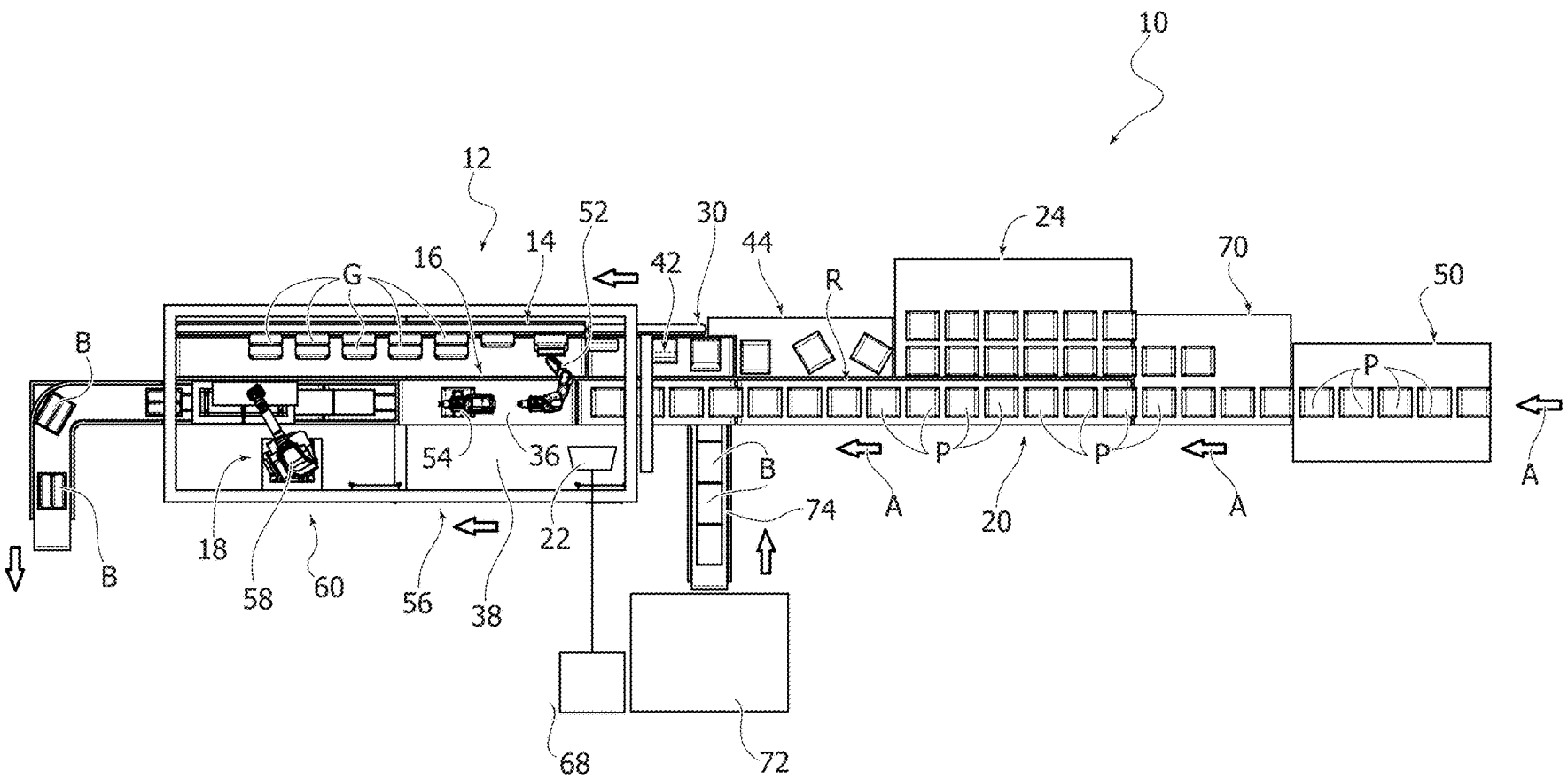

FIG. 2 illustrates a second embodiment of a system according to the present invention. The elements corresponding to those previously described are indicated with the same reference numerals.

In the embodiment of FIG. 2, the boxing machine 12 has a single entry station 36 that receives the product array R fed by the main feeding conveyor 20. The replenishment conveyor 30 is arranged to feed products P coming from the buffer 24 directly to the product group conveyor 14. In this case, the products P coming from the buffer 24 and fed to the boxing machine 12 by the replenishment conveyor 30 are not picked up by a handling device to be placed on the product group conveyor 14, but instead pass directly from the outlet of the replenishment conveyor 30 to the inlet of the product group conveyor 14.

The products P located on the replenishment conveyor 30 remain stationary and ready to be used. When the detection device 22 detects the presence of one or more empty spaces in the product array R fed to the entry station 36, the replenishment conveyor 30 is activated to feed one or more products P to the product group conveyor 14.

In both the embodiment of FIG. 1 and the embodiment of FIG. 2, the system 10 is controlled based on the information provided by the detection device 22 so as to use products P coming from the replenishment conveyor 30 for the formation of product groups G when empty spaces are detected in the product array R fed by the main feeding conveyor 20 to the boxing machine 12.

In the embodiment of FIG. 2, the system 10 may comprise a first orientation device 42 configured to vary the orientation of the products P moving along the replenishment conveyor 30. For example, the first orientation device 42 may rotate the products P around a horizontal axis parallel to the transport direction A.

In the embodiment of FIG. 2, the system 10 may also comprise a second orientation device 44 configured to vary the orientation of the products between the buffer 24 and the inlet of the replenishment conveyor 30. For example, the second orientation device 44 may rotate the products P by 90° around a vertical axis orthogonal to the transport direction A.

A particularly advantageous feature of the embodiment of FIG. 2 is that the products P coming from the replenishment conveyor 30 can be fed to the product group conveyor 14 already correctly oriented for the formation of the product groups G. It is also particularly advantageous that, during the feeding of products P from the replenishment conveyor 30 to the product group conveyor 14, the anthropomorphic robots 52, 54 located in the group-forming section 56 are free to prepare for picking up subsequent products P, which results in shorter package formation times and improved efficiency of the boxing machine 12.

Figure 3:
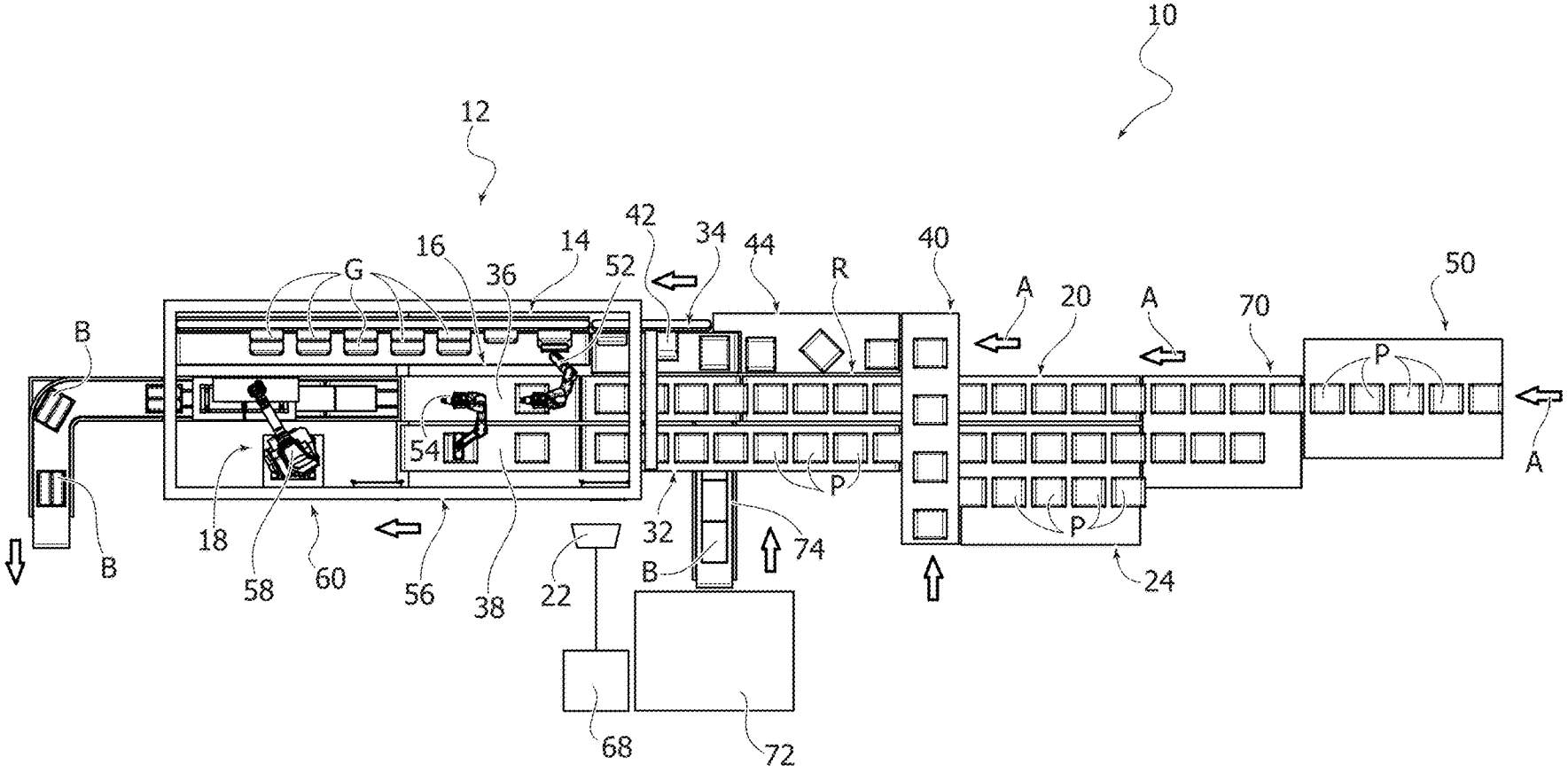
Figure 4:
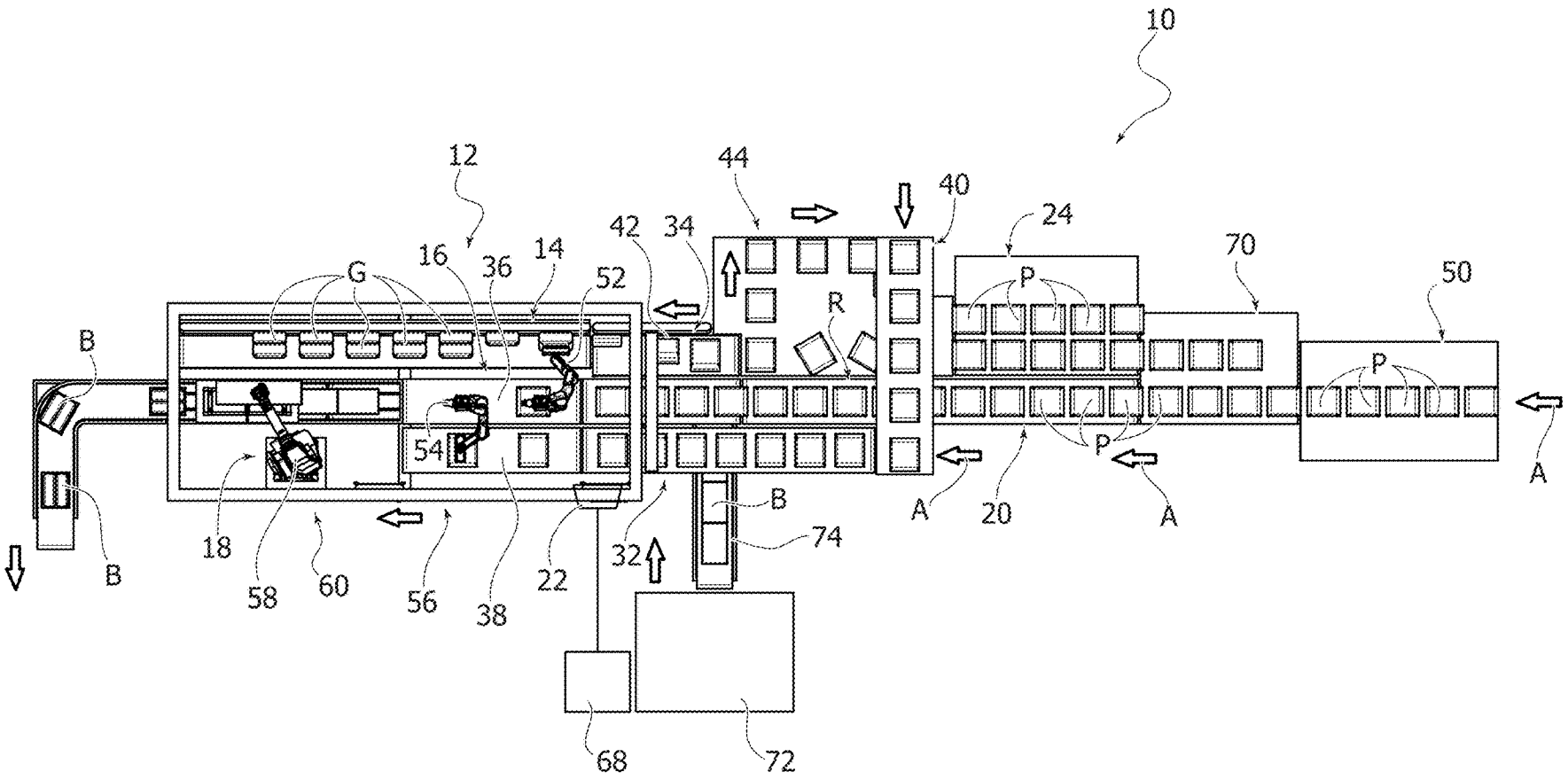

FIGS. 3 and 4 illustrate further embodiments of a system according to the present invention. The elements corresponding to those previously described are indicated with the same reference numerals.

In the embodiments of FIGS. 3 and 4, the boxing machine 12 has a first entry station 36 that receives the product array R fed by the main feeding conveyor 20 and a second entry station 38 that receives products P fed by a first replenishment conveyor 32. The system 10 also comprises a second replenishment conveyor 34 arranged to feed products P directly to the product group conveyor 14.

In the embodiments of FIGS. 3 and 4, the system may comprise a bypass system 40 configured to selectively route products P coming from the buffer 24 towards the first replenishment conveyor 32 or towards the second replenishment conveyor 34.

The system illustrated in FIGS. 3 and 4 may comprise a first orientation device 42 configured to vary the orientation of the products P moving along the second replenishment conveyor 34 and a second orientation device 44 configured to vary the orientation of the products P between the outlet of the buffer 24 and the inlet of the second replenishment conveyor 34.

In the embodiments of FIGS. 3 and 4, the products P located at the second entry station 38 and the products located on the second replenishment conveyor 34 remain stationary and ready to be used for the formation of product groups G when one or more empty spaces are detected at the first entry station 36. For the composition of product groups G, the products located at the second entry station 38 and those on the second replenishment conveyor 34 may be selectively used.

According to further embodiments, the detection device 22 may be positioned between the output of the production line 50 and the inlet of the boxing machine 12. In this way, the detection device 22 can detect the presence of empty spaces in the product array R as it is conveyed along the main feeding conveyor 20. The detection device 22 can thus send information regarding the presence of empty spaces in the product array R to the electronic control unit 68 before the empty spaces reach the boxing machine 12. This makes it possible to activate the replenishment conveyors 30, 32, 34 in advance of the arrival of the empty spaces at the boxing machine 12, thereby effectively feeding products from the buffer 24. This feature is particularly advantageous because it ensures the availability of products from the buffer 24 for the purpose of the invention, thus avoiding potential slowdowns of the boxing machine 12.

In the various embodiments, when the detection device 22 detects the presence of multiple closely spaced empty spaces in the product array R fed to the entry station 36, the replenishment conveyor 30, 32, 34 can be activated to feed a number of products P to the boxing machine 12 equal to or greater than the number of detected closely spaced empty spaces. By closely spaced empty spaces, one may understand, for example, contiguous empty spaces or empty spaces separated by a reasonably small number of products P, such as 1, 2, or 3 products P, or even up to 10 products P.

According to a further advantageous aspect, when products from the buffer 24 are used to form product groups G, the replenishment conveyor 30, 32, 34 can be activated to transport additional products from the buffer 24 to the immediate vicinity of the second entry station 38 or of the product group conveyor 14, in order to promptly make products from the buffer 24 available to the boxing machine 12 for the purpose of the invention.

According to further embodiments, the main feeding conveyor 20 may receive products P from more than one production line 50 and transfer them to the boxing machine 12. The system 10 may comprise a conveying system located upstream of the main feeding conveyor 20 and configured to channel products P from the production lines 50 to the main feeding conveyor 20. Even more advantageously, the conveying system may comprise a selective conveying device configured to selectively connect one or more production lines 50 to the main feeding conveyor 20 so as to convey to the main feeding conveyor 20 the products P coming from one or more desired production lines 50.

In all embodiments, the products P coming from one or more production lines 50 may be of the same type or of different types, differing by way of non-limiting example in size, format, intended use, production batch, or any other characteristic useful for identifying a type of product P.

The system according to the present invention, in operation, implements a method for boxing products P, comprising:

- providing a boxing machine 12 including: a product group conveyor 14, a first robotic unit 16, and a second robotic unit 18,
- feeding to the boxing machine 12 an array of products R made up of products P aligned with each other in a transport direction A via a main feeding conveyor 20,
- picking up products P from the product array R using the first robotic unit 16 and forming product groups G on the product group conveyor 14,
- accumulating products P in a buffer 24,
- feeding to the boxing machine 12 products P coming from the buffer 24 via at least one replenishment conveyor 30,
- detecting the presence of empty spaces in the product array R using a detection device 22,
- using products coming from at least one replenishment conveyor 30 for the formation of product groups G when the detection device 22 detects the presence of empty spaces in the product array R, and
- picking up product groups G from the product group conveyor 14 and inserting the product groups G into respective boxes B using the second robotic unit 18.

The method may comprise feeding products P coming from the replenishment conveyor 30 directly to the product group conveyor 14 and varying the orientation of the products P fed to the product group conveyor 14 from the replenishment conveyor 30.

Advantageously, a system 10 according to the present invention allows optimizing the replenishment flow of products coming from the buffer 24, resulting in improved overall performance of the production plant, as measured for example with reference to OEE (Overall Equipment Effectiveness), where the production plant refers to the set of production lines 50 and the boxing machine 12.

Even more advantageously, the replenishment conveyors 30, 32, 34 may extend along the entire length of the first robotic unit 16 so as to reach the working areas of the anthropomorphic robots 52, 54 included in the first robotic unit 16. Such a configuration would ensure the availability of products from the buffer 24 for the purpose of the invention and would optimize the workload balancing of the anthropomorphic robots 52, 54.

Still more advantageously, the replenishment conveyors 30, 32, 34 may extend up to the working area of the first anthropomorphic robot 52 arranged along the transport direction A. Such a configuration would allow better accessibility to the boxing machine 12, for instance in case of operator intervention.

Even more advantageously, a system 10 according to the present invention allows the use of products coming from the buffer 24 both when empty spaces are detected in the product array R coming from the production line 50 and when the production line 50 is stopped.

In this way, the products from the buffer 24 can feed the boxing machine 12 both in the mode of replenishing empty spaces as described above and when the production line is stopped and the boxing machine 12 is fed exclusively by products P coming from the buffer 24.

Naturally, without prejudice to the principle of the invention, the construction details and embodiments may vary widely without departing from the scope of the invention as defined in the following claims.

The invention claimed is:

1. A system for boxing products, comprising:

a boxing machine including:

a product group conveyor, a first robotic unit configured to form product groups on said product group conveyor, and a second robotic unit configured to take product groups from said product group conveyor and insert said product groups into respective boxes, a main feeding conveyor configured to feed to the boxing machine an array of products made up of products aligned with each other in a transport direction, a detection device configured to detect a presence of empty spaces in said array of products, a buffer for an accumulation of products, at least one replenishment conveyor configured to feed products coming from said buffer to said boxing machine, wherein the system is controlled to use products coming from said at least one replenishment conveyor for formation of the product groups when said detection device detects the presence of empty spaces in said array of products.

2. The system of claim 1, wherein the boxing machine comprises a first entry station which receives the array of products fed by the main feeding conveyor and a second entry station which receives products fed by said at least one replenishment conveyor.

3. The system of claim 1, wherein said at least one replenishment conveyor is arranged to feed the products directly to said product group conveyor.

4. The system of claim 1, wherein the at least one replenishment conveyor comprises a first replenishment conveyor and a second replenishment conveyor, and wherein the boxing machine comprises a first entry station which receives the array of products fed by the main feeding conveyor, a second entry station which receives the products fed from the first replenishment conveyor, and wherein the second replenishment conveyor is arranged to feed the products directly to said product group conveyor.

5. The system of claim 4, comprising a bypass system configured to selectively route the products coming from said buffer towards the first replenishment conveyor or towards the second replenishment conveyor.

6. The system of claim 3, wherein said at least one replenishment conveyor is associated with a first orientation device configured to vary an orientation of the products moving along the at least one replenishment conveyor.

7. The system of claim 6, comprising a second orientation device configured to vary the orientation of the products between the buffer and an inlet of the at least one replenishment conveyor.

8. A method for boxing products, comprising:

providing a boxing machine including: a product group conveyor, a first robotic unit, and a second robotic unit, feeding to the boxing machine an array of products made up of products aligned with each other in a transport direction via a main feeding conveyor, picking up products from the array of products using the first robotic unit and forming product groups on the product group conveyor, accumulating products in a buffer, feeding products coming from said buffer to said boxing machine via at least one replenishment conveyor, detecting a presence of empty spaces in said array of products using a detection device, using products coming from said at least one replenishment conveyor for formation of the product groups when said detection device detects the presence of empty spaces in the array of products, and taking product groups from the product group conveyor and inserting the product groups into respective boxes using the second robotic unit.

9. The method of claim 8, comprising feeding products coming from said at least one replenishment conveyor directly to said product group conveyor.

10. The method of claim 9, comprising varying an orientation of the products fed to said product group conveyor from said at least one replenishment conveyor.

* * * * *